US006478662B1

(12) United States Patent
Krejcik

(10) Patent No.: US 6,478,662 B1
(45) Date of Patent: Nov. 12, 2002

(54) DESCALER/FINISHER FOR ELONGATED OR CONTINUOUS STOCK MATERIALS

(76) Inventor: Charles J. Krejcik, P.M.B. 107, 420 Wal-Mart Way, Dahlone, GA (US) 30533

( * ) Notice: Subject to any disclaimer, the term of this patent is extended or adjusted under 35 U.S.C. 154(b) by 0 days.

(21) Appl. No.: 09/651,080

(22) Filed: Aug. 30, 2000

Related U.S. Application Data

(60) Provisional application No. 60/151,754, filed on Aug. 31, 1999.

(51) Int. Cl.[7] ..... B24C 3/00

(52) U.S. Cl. ..... 451/75; 451/89; 451/95

(58) Field of Search ..... 451/75, 83, 89, 451/94, 95, 105, 38, 96

(56) References Cited

U.S. PATENT DOCUMENTS

| | | | | |
|---|---|---|---|---|
| 3,481,080 A | * 12/1969 | Davidson | 451/83 |
| 3,626,641 A | * 12/1971 | Powell et al. | 451/83 |
| 3,903,652 A | * 9/1975 | Baughman et al. | 451/83 |
| 4,872,294 A | * 10/1989 | Watts | 451/83 |
| 6,319,101 B1 | * 11/2001 | Vago | 451/94 |

* cited by examiner

*Primary Examiner*—Joseph J. Hail, III
*Assistant Examiner*—David B. Thomas
(74) *Attorney, Agent, or Firm*—Finnegan, Henderson, Farabow, Garrett & Dunner

(57) ABSTRACT

A device for cleaning stock material, such as wire, rod, or tubing, comprises two separate blast chambers, each blast chamber adapted for receiving abrasive projected by two blast wheels. Each blast wheel creates a blast zone in the blast chamber through which the stock material passes. The blast zones are oriented to provide a surface treatment on all or a portion of the exterior surface of the stock material.

12 Claims, 2 Drawing Sheets

DESCALER/FINISHER FOR ELONGATED OR CONTINUOUS STOCK MATERIALS

CROSS-REFERENCE TO RELATED APPLICATION

This application hereby claims the benefit under 35 U.S.C. § 119(e) of U.S. Provisional Application Ser. No. 60/151,754, filed Aug. 31, 1999. The entire disclosure of this provisional application is relied upon and incorporated by reference herein.

FIELD OF THE INVENTION

This invention relates to a device and method for cleaning and descaling elongated or continuous stock materials, such as metal rod or wire. More particularly, the device of this invention incorporates abrasive throwing wheels to clean stock materials, such as metal or plastic wire, rod, or tubing, in a continuous or intermittent operation.

BACKGROUND OF THE INVENTION

Due to the desire of the wire industry to discontinue use of acid to clean newly manufactured rod and wire, there is a need for a machine to descale and profile finish the product. Attempts have been made to shot blast the wire clean with steel media; however, these machines are adaptations from other industries and do not suit wire makers needs because:

1. The wire must be threaded through the machines often, and these machines are difficult to access causing long delays.

2. The poor positioning of the shot throwing devices makes them inefficient and maintenance intensive.

3. Their size prohibits use by city mills because of lack of space and no expansion room.

Thus, there is a need in the art for a descaling/finishing machine for metal wire and metal rod. The device should be of small size, provide efficient cleaning, be inexpensive and safe to operate over a range of material processing rates, and adaptable for use with a variety of other elongated or continuous stock materials.

SUMMARY OF THE INVENTION

This invention aids in fulfilling these needs in the art. More particularly, this invention provides:

a device for cleaning stock material, wherein the device comprises:

(A) an enclosed first blast chamber for receiving abrasive projected by two blast wheels, wherein the first blast chamber has a stock material inlet for passage of stock material into the first blast chamber and a stock material outlet for discharge of treated stock material from the first blast chamber; and (B) an enclosed second blast chamber for receiving abrasive projected by two blast wheels, wherein the second blast chamber has a stock material inlet for receiving stock material from the stock material outlet of the first chamber, and a stock material outlet for discharge of treated stock material from the second blast chamber;

wherein each blast wheel projects abrasive in an abrasive pattern having a blast zone in each blast chamber such that each blast zone is in the path of the stock material passing through each blast chamber; and wherein ¼ of the surface area of the stock material is treated in the blast zone of each blast wheel such that the whole surface area of the stock material is treated after the stock material passes through the first blast chamber and through the second blast chamber.

BRIEF DESCRIPTION OF THE DRAWINGS

This invention will be described in detail with reference to the drawings in which.

DETAILED DESCRIPTION OF THE INVENTION

Figure 2:
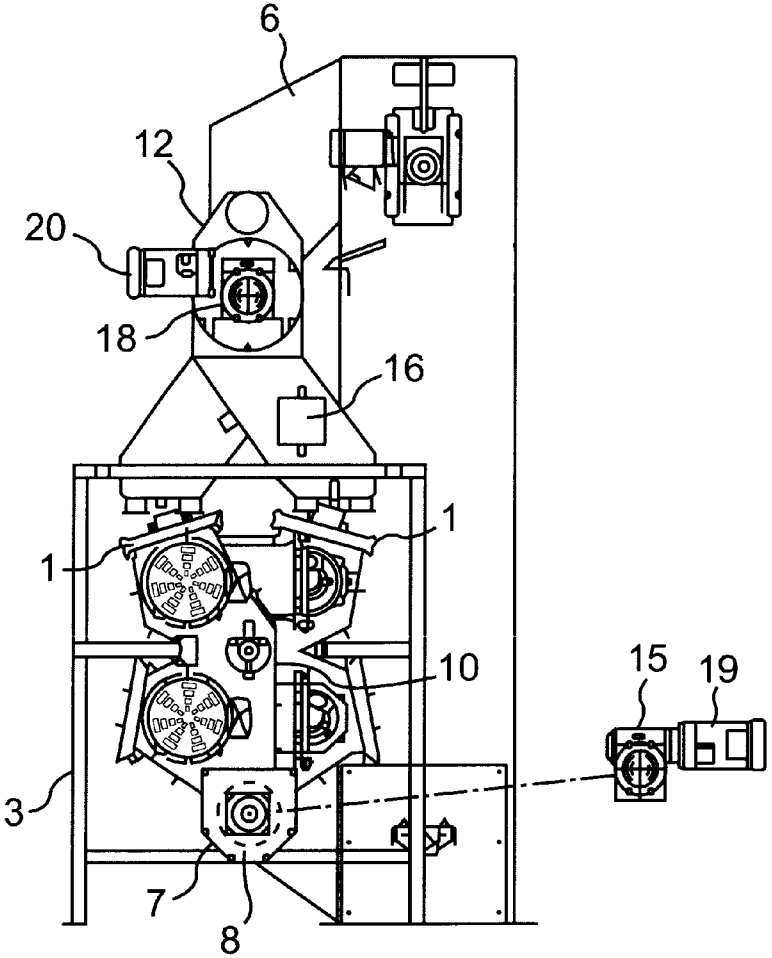
FIG. 2 is a side view of the wire and rod descaler/finisher of FIG. 1.
Figure 1:
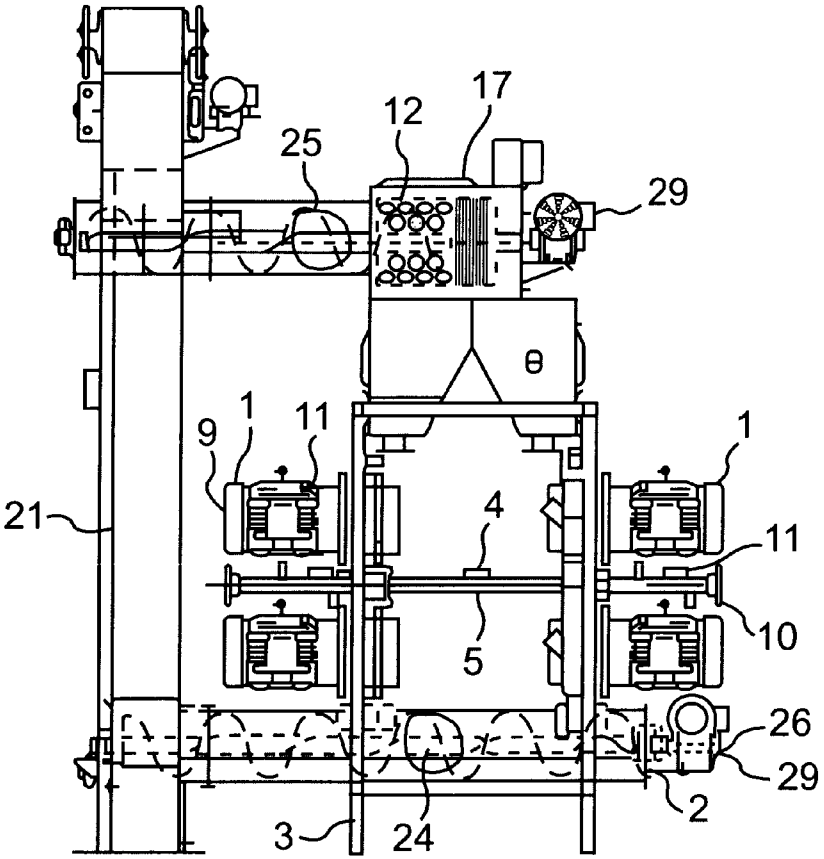
FIG. 1 is a front view of a wire and rod descaler/finisher of this invention.
Figure 3:
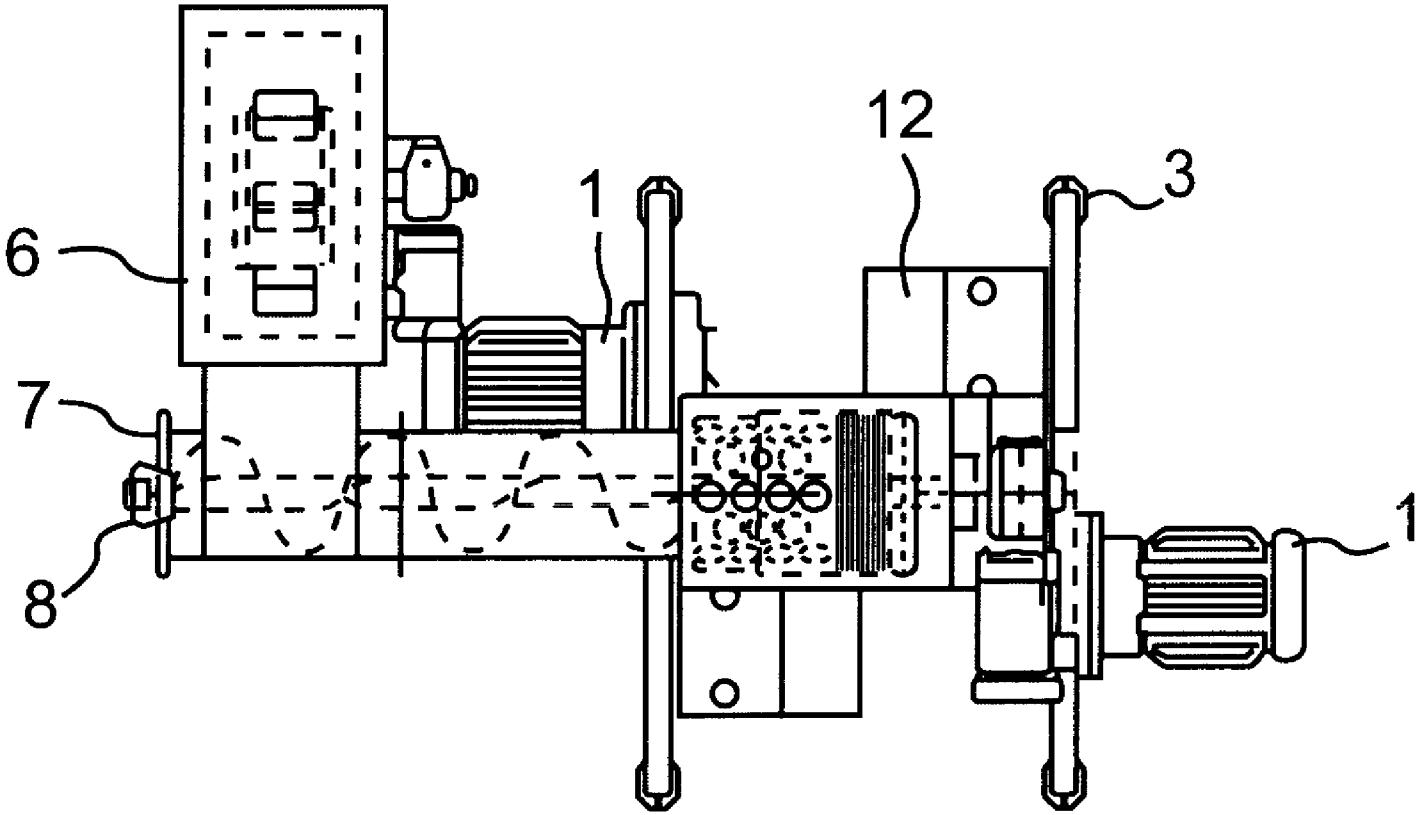
FIG. 3 is a top view of the wire and rod descaler/finisher of FIG. 1.

FIGS. 1, 2, and 3 depict a cleaning and descaling machine of the invention comprised of the following components:

1. 10 HP Baldor C faced electric motor
2. Lower screw conveyor assembly
3. Frame
4. Wire tray cover
5. Wire tray
6. Elevator cover
7. Upper screw conveyor assembly
8. Bearing and flange assembly
9. Guide
10. Guide
11. Exit tray cover
12. Screen drum assembly
15. Lower screw conveyor drive
16. Hopper access
17. Screen cover
18 Upper screw conveyor drive
19. 2 HP drive motor
21. Bucket elevator
24. 9" RH screw conveyor
26–29. Drive support More particularly, the machine of this invention comprises two blast chambers that contain the blast wheels and guides as shown in the Figures. Each blast chamber is lined by extremely hard steel case plating. The blast wheels are positioned within the blast chambers very close to the wire or rod being cleaned and finished. The blast wheels are powered by two 10 horsepower motors 1 for each blast chamber. The spent abrasive and dire fall into the bottom of the blast chamber, flowing into a screw conveyor 24, which takes it to a bucket elevator 21 that deposits it into a rotating screen drum separator 12. The clean abrasive media then falls into a storage hopper 16 for reuse by the blast wheels. The dirt and other debris are discarded.

The wire is easily and safely threaded through the blast chambers, since the distance is so short (less than 12 inches). The tray 5 connecting the blast chambers swings open at the top 4 to allow for ease of loading in this area. Steel pipes at both ends of the blast chamber, flooded by abrasive from the hopper, seal the blast chambers to keep abrasive from escaping during the cleaning process.

The wire is pulled through the wire descaler/finisher by a drawing machine that draws the wire down to the desired size. Adjustable shot gates that feed the abrasive to the blast wheels control the amount of abrasive thrown per a given speed. These blast wheels are 9 inches in diameter, have 4 blades, an impeller, and control gage to direct the abrasive onto the wire. While the device of this invention and its use are described herein in terms of the treatment of wire, it will be understood that the description equally applies to other stock materials.

The device and method of this invention can be employed for cleaning, abrading, finishing, or descaling any type of elongated or continuous stock material. As used herein, the expression "elongated stock material" means stock materials having a length up to about 40 feet. Typical of such materials are lengths of rod or tubing that can be manually or mechanically feed to the device of the invention. As used herein, the expression "continuous stock material" refers to stock materials having lengths greater than about 8 feet. The continuous stock materials may even be hundreds of feet in length, which is the case for metal wire wound on a spool that is feed to the device of the invention.

The stock material can have most any composition, such as metal, plastic, or synthetic composites. Continuous stock materials of different compositions can be treated in the device of the invention by adjusting the velocity of the abrasive projected onto the surface of the material, adjusting the volume of abrasive projected onto the surface, or by both of these means.

The stock material typically has a solid cross-section, although stock materials with hollow cross-sections or openings in the cross-sections can also be treated according to the invention. In a preferred embodiment of the invention, the stock material is a rod, wire, or tubing. It is particularly preferred that the stock material be a metal rod, metal wire, or metal tubing.

The continuous stock material treated according to the invention can be of substantially any shape. For example, stock materials having round, oblong, square, rectangular, hexagonal, or other regular or irregular geometric cross-sections are suitable for use in the invention. Because of the placement of the blast wheels in the blast chambers, the cross-sectional shape of the stock material has not been found to be critical; projecting the abrasive perpendicular to the surface of the stock material provides sufficient media at different angles to clean stock materials of irregular cross-sectional shape. Nevertheless, continuous stock material of substantially circular cross-section is usually treated according to the invention.

The continuous stock material treated according to the invention has a relatively small cross-sectional area. For example, typical stock materials have cross-sectional areas of about 0.003 $in^2$ to about 12.5 $in^2$, preferably about 0.049 $in^2$ to about 12 $in^2$.

The stock material can be rigid or flexible. Typically, the stock material will be flexible and will not be self-supporting outside the device of the invention.

The stock material is treated with abrasive particles in the device of the invention in a continuous or intermittent operation. Continuous operation is preferred, especially with metal wire or metal rod, which is being treated before being drawn through a die to the desired cross-sectional configuration and surface characteristics.

The continuous stock material can be fed to the device of the invention either manually in sections or continuously from a storage means, such as a spool. In a preferred mode of operation, metal wire or metal rod is continuously fed from a spool into the first blast chamber. The stock material can be supported as needed between the storage means and the blast chamber. In one embodiment, wire stored on a spool is fed from the spool through a supporting boom in a manner that causes the wire to reciprocate back and forth from one end of the spool to the other as the wire is fed from the spool. When the wire changes direction in this manner, a twist is imparted to the wire, which is eventually removed as the wire passes through the process. The device of this invention also can be used by feeding wire from one spool after another after the wires on different spools are welded together.

The device of the invention is adapted for use in processes in which the continuous stock material is fed at a high rate to the blast chamber. Conventional descaler and finishing machines operate at a speed of only up to about 180 feet per minute. The device of this invention can efficiently operate at stock material feed rates of about 5 feet per minute to about 300 feet per minute, preferably about 10 feet per minute to about 300 feet per minute.

One of the unique features of the device of this invention is the provision of two, small blast chambers. Each blast chamber is fitted with two blast wheels that are positioned relative to each other and relative to the stock material to ensure efficient treatment of the outer surface of the stock material. While the blast wheels can be positioned inside the blast chamber, it is preferred that the blast wheels be located outside the blast chamber, which is provided with an opening for receiving abrasive projected from each blast wheel into the blast chamber.

In a preferred embodiment of the invention, each blast chamber is formed by joining two conventional blast wheel housings at their open ends to form an enclosed blast chamber. The blast wheels can then be rigidly mounted on the outside walls of the resulting chamber after providing openings in the chamber for the passage of abrasive propelled by the blast wheel against the surface of the stock material. Since blast wheel housings are only about 5" to 6" in height, this assembly provides a narrow blast chamber of approximately the same size as the housing on the blast wheel.

One end of the blast chamber is provided with a funnel-shaped opening to receive the stock material, and the opposite end of the blast chamber is provided with an opening for discharge of the treated stock material from the blast chamber. The stock material can be fed through the chamber via these openings. These openings are hereinafter referred to as "the stock material inlet" and "the stock material outlet", respectively.

A significant advantage of the device of the invention is the ease with which the stock material can be fed into the blast chamber without requiring access to the interior of the blast chamber. Both the stock material inlet and the stock material outlet are simultaneously accessible to the operator because of the small size of the blast chamber. This is important because the blast chamber and the blast wheel components become very hot in use, making it dangerous to access these parts without a cool down period. For example, if it becomes necessary to thread wire through the blast chamber, this can be accomplished without opening the blast chamber and without the operator contacting hot parts of the apparatus. It is a simple matter to thread the stock material into the stock material inlet, through the blast chamber, and through the stock material outlet, either manually or with the aid of a small hand tool, without contacting the hot apparatus. Thus, the stock material can be threaded into one end of the blast chamber with one hand and pulled through the blast chamber from the other side with the other hand. After threading the stock material through the first blast chamber, the same procedure can be followed for threading the stock material through the second blast chamber.

In a preferred embodiment of the invention, an enclosed tray 5 is provided between the stock material outlet in the first blast chamber and the stock material inlet in the second blast chamber. The partially treated stock material exiting the first blast chamber passes over this tray into the second blast chamber. The interior of enclosed tray is preferably unobstructed. By providing an access opening 4 in the enclosed tray 5, which can be open and closed, threading the wire from the first blast chamber into the second blast chamber is greatly facilitated. Once again, it is unnecessary for the operator to risk contact with hot components of the apparatus because the enclosed tray between the two blast chambers remains at substantially ambient temperature.

Because of the small size of each blast chamber, typically about five to six inches wide, it has been discovered that the stock material can be unsupported inside the blast chamber between the stock material inlet and the stock material outlet. Even stock material that is not self-supporting inside the blast chamber can be blasted in the chamber without the aid of an intermediate support inside the blast chamber because of the short distance traversed by the stock material between the stock material inlet and stock material outlet. Thus, the stock material can be treated without a support, such as a roller or guide device, within either blast chamber.

One piece of stock material is passed through each blast chamber. The device of this invention is suitable for treating the entire external surface area of the stock material or only sections thereof. Since a circumference of 360° of the stock material is usually to be treated, a suitable number of blast wheels are provided to achieve this result. Four blast wheels have been found to be adequate to clean the 360° circumference of metal wire and metal tubing, two of these blast wheels being provided for each of the two blast chambers. While more blast wheels could be employed, there is no apparent advantage in using more than four blast wheels for processing most high volume stock materials.

When it is necessary to clean the entire external surface area of the stock material, it is convenient to clean one half of the surface area in each blast chamber. Each blast wheel can then be positioned to clean ¼ of the surface area of the stock material passing through the blast chamber. Thus, each blast wheel can be positioned to blast in a 90° quadrant around the stock material. In a preferred placement of the blast wheel relative to the blast chamber, the throwing surfaces of the blast wheels do not face each other. The axis of blast one wheel can be positioned at an angle of about 45° to the axis of the other blast wheel. This ensures maintenance of two distinct blast zones in each blast chamber as the stock material passes therethrough, and minimizes the likelihood of damage to one blast wheel by the abrasive from the other blast wheel.

Spent abrasive collects in the bottom of each blast chamber forming a layer of spent abrasive that has been depleted of its kinetic energy. The layer of spent abrasive floods an opening at the bottom of the blast chamber for discharging the spent abrasive from the chamber.

Inadequate surface treatment may affect surface characteristics such that further processing of the stock material is adversely affected. For example, if a metal wire is inadequately descaled and finished, it may pick up an insufficient amount of lubricant before it passes into the die forming apparatus. This can lead to premature die wear and die failure. On the other hand, excessive treatment of the surface of the metal wire may result in too much of the lubricant being picked up before the wire enters the die forming apparatus. This may adversely affect drawing and shaping of the wire in the die. Optimum parameters for the stock material being treated can be determined through routine experimentation and may vary from one stock material to another. The blast pattern, abrasive velocity, and volume of abrasive propelled, as well as the recovery and cleaning of spent abrasive, are important parameters to control in order to ensure the proper surface finish on the stock material.

The blast pattern, and thus the blast zone, can be controlled by means of a conventional control cage. Control cages are standard on blast machines that employ blast wheels. The control cage can be used to aim the abrasive onto the blades of the blast wheel, which determines where the abrasive will be projected from the outer edges of the blades. This in turn determines the blast pattern inside the blast chamber.

Each blast wheel propels abrasive at high speed in a pattern that includes a blast zone through which the stock material to be treated passes. The blast zone is defined by a plane of substantially elliptical shape. The blast zone is typically about 7 inches to about 9 inches long, and about 1.5 inches to about 2 inches wide at its greatest dimensions. The elliptically shaped plane of the blast zone preferably forms a 90° angle with an extended radius of the blast wheel, and preferably, the stock material traverses a linear path in the blast zone such that the linear path of the stock material coincides with the major axis of the ellipse on the elliptically shaped plane of the blast zone.

The discharge opening for the abrasive in the control cage can be configured to provide a uniform pattern of abrasive over the blast zone. For example, if a single opening of considerable peripheral length is provided in the control cage, the abrasive may not be evenly distributed over the blast zone, and consequently the work surface. This can be overcome by providing a series of spaced openings in the control cage, wherein the openings progressively increase in area in the direction of rotation of the blast wheel. The proper size of the openings in the control cage to obtain even distribution of the abrasive against the work surface can readily be determined with a minimum of experimentation with the particular type of abrasive to be used. This configuration can avoid the problem frequently encountered with blast patterns having an area of high intensity blast in the center and a faded blast intensity proximate the edges of the blast zone. This configuration can provide a consistent abrasive pattern in which the typical hot spots all but disappear.

It is also important to control the distance from the outer surface of the stock material being treated to the outer end of the throwing blades on the blast wheels. This is to ensure that the stock material passes through the region of maximum intensity of the blast zone. This region generally coincides with the portion of the blast zone where the concentration of abrasive and velocity of the abrasive are the greatest. It is desirable for the surface being treated to coincide with this region of the blast zone to minimize the likelihood of overshooting the stock material or under treating the stock material with abrasive that has lost its kinetic energy. A distance of about 8½ inches from the outer edge of the throwing blades on the blast wheels to the surface of metal wire being blasted has been found to be suitable.

Treatment of the surface of the stock material and the surface characteristics imparted by the abrasive will of course be affected by the velocity of the abrasive leaving the blast wheel. Abrasive velocity can conveniently be controlled by controlling the speed of the blast wheel. The blast wheel is generally electrically driven, and a variable speed electric drive has been found to be suitable for controlling the speed of the blast wheel. The velocity of the abrasive not only depends on the surface being treated, but also the nature of the abrasive employed. For example, an abrasive comprised of stainless steel shot typically requires a higher abrasive velocity for the same treatment effect on metal wire than a high carbon steel abrasive of similar size. The optimum abrasive velocity can be determined by simple routine experimentation.

Another parameter that affects the surface characteristics imparted to the stock material after it is abraded is the flow rate of the abrasive fed to the blast wheels. The flow rate of abrasive can conveniently be regulated by a gate valve between the abrasive storage hopper and the blast wheel inlet. In a preferred embodiment of the invention, the gate valve is provided with a conventional air cylinder having a control that can be used to regulate the flow of abrasive from the hopper to the blast wheel inlet.

The spent abrasive is recycled by means of a screw conveyor, which feeds spent abrasive to a bucket elevator, which in turn raises the spent abrasive to another screw conveyor and into the hopper after the abrasive is cleaned of debris. Uniform, controllable, and reproducible surface treatment of stock material requires a shot pattern of consistent size and a shot pattern composed of a consistent and reproducible abrasive composition. For example, dirt and debris from the abrading operation can adversely affect these performance characteristics if the dirt and debris are recirculated through the abrasive recovery system to the blast wheels and into the blast zone. While the dirt and debris can be separated from the spent abrasive before it is recycled to the blast wheel, it has been found that the conventional air wash systems used in abrasive recovery systems are unsuitable. This invention utilizes a rotating screen separator to ensure adequate separation of dirt and debris from recycled abrasive. This has been found to ensure the maintenance of proper performance criteria, and in particular, abrasive patterns and blast zones of uniform size and composition. Thus, the abrasive recycled to the blast chambers should be essentially free of debris that would abrade the surface of the stock material being treated, disrupt the flow of abrasive from the blades on the blast wheels, or mask the surface being treated to an extent that would materially detract from the beneficial effects of the abrasive.

It has been found that it is important to blast the stock material substantially perpendicular to the direction of movement of the stock material through the blast zone. Controllable and reproducible surface treatment of stock material cannot be achieved when the abrasive is projected against the stock material parallel to the direction of movement of the blast material through the blast chamber. This is believed to be due to the fact that the blast stream is very small, typically only 1½ to 2 inches wide, and it is difficult to maintain movement of the stock material through the region of the blast zone having the highest energy intensity and abrasive concentration. Thus, the device and method of the invention are not carried out with blast patterns that are parallel to, or inclined near parallel, to the direction of movement of the stock material through the blast chamber.

The use of guides or baffles for directing the abrasive onto the surface of the stock material should be avoided. The abrasive may become pinned against the guides or baffles and thereby fail to impact the surface to be treated. The abrasive may also impact the guides or baffles, thereby dissipating the kinetic energy of the abrasive, leaving the abrasive with insufficient kinetic energy to achieve the desired surface characteristics on the stock material.

It will be apparent from this description that abrasive particles are continuously impacted on the surface to be cleaned and continuously removed from the surface to prevent accumulation of spent abrasive particles. Substantially all of the spent abrasive material remains within the blast chambers. In fact, the spent abrasive that forms in the bottom of each blast chamber functions as an energy absorbing layer, which the spent abrasive from the blast zone impacts, thereby dissipating the kinetic energy of the spent abrasive into the layer. The layer of abrasive material ensures that spent abrasive from the blast zone will impact the layer without rebounding or ricocheting within the blast chamber to an extent that damages the blast wheels or interferes with the surface treatment.

The blast chambers employed in the apparatus of this invention are generally made of a light weight material, such as thin gage steel or aluminum. Portions of the blast chambers can be lined with a replaceable, abrasion resistant material. For example, the interior portions of the blast chambers that are susceptible to contact with abrasive can be lined with manganese steel, cast alloys, or hardened plates. This is conveniently accomplished by using replaceable liners of the type well known in the art. Similarly, other surfaces in the apparatus of the invention subject to wear can be lined with an abrasion resistant material.

Any of the well known means for projecting abrasive particles against a surface to be treated can be employed in the device of this invention. Preferred throwing means comprise airless centrifugal blast wheels of the type described in U.S. Pat. Nos. 3,867,791, 4,244,150, and 4,249,350.

A preferred airless, centrifugal blast wheel has a diameter of about 15 inches, four throwing blades and operates at about 3450 rpm. The abrasive is projected toward the surface being treated at a rate of 180 pounds to about 190 pounds per minute for a machine having a blast zone of about 36 inches wide. The rotational speed of the blast wheel and the quantity of abrasive required for blast zones of other dimensions can be readily determined with a minimum of experimentation. A particularly preferred centrifugal wheel for use in an apparatus for treating metal wire having a diameter of about 0.5 inches comprises a blast wheel of about 9 inches in diameter, a rotational speed of about 3600 rpm, four throwing blades, and an abrasive flow rate of about 285–295 pounds per minute for a blast zone about 10 inches long and about 2 inches wide at its maximum dimension.

Any type of conventional abrasive material can be employed in the device of this invention. For example, one can use metal shot, slag, sand, volcanic ash, glass beads, metal oxide particles, zircon, garnet, carborundum, stone, etc. Metal shot of substantially spherical shape is preferred because of its durability and its effects on the surface being treated. Spherically shaped abrasive gives a good blast pattern and profile on the treated surface. While angular shaped particles can also be employed, the profile of the treated surface is frequently characterized by peaks and valleys. When the abraded surface is to be subsequently treated, such as with a lubricant, the peaks and valleys can cause the undesirable accumulation of treating material in localized areas of the abraded surface. A preferred abrasive comprises stainless steel shot having a size of SLW 20. A particularly stainless steel shot is available from Vulkan Shotblast Technology under the trademark VULKAN®.

The unique features of this machine are:

1. The wheel positions perpendicular to the wire so that the wire never can get out of the blast streams.

2. The loading method through the blast chambers and the tray so that an operator does not have to sacrifice time, comfort, and safety by entering a dangerous shot blast machine.

3. The compact size permits use by all mills.

4. The close proximity of the blast wheels to the wire promotes the use of less than half of the horsepower previously needed by other methods.

What is claimed is:

1. A device for cleaning stock material, wherein the device comprises:

(A) an enclosed first blast chamber for receiving abrasive projected by two blast wheels, wherein the first blast chamber has a stock material inlet for passage of stock material into the first blast chamber and a stock material outlet for discharge of treated stock material out of the first blast chamber;

(B) an enclosed second blast chamber for receiving abrasive projected by two blast wheels, wherein the second blast chamber has a stock material inlet for receiving stock material from the stock material outlet of the first chamber, and a stock material outlet for discharge of treated stock material out of the second blast chamber;

wherein each blast wheel projects abrasive in an abrasive pattern having a blast zone in the blast chamber such that a segment of the stock material simultaneously passes through each blast zone as the stock material traverses a linear path through each blast chamber; and wherein ¼ of the surface area of the stock material is treated by each blast wheel such that the whole surface area of the stock material is treated after the stock material passes through the first blast chamber and through the second blast chamber.

2. The device as claimed in claim 1, wherein the stock material is unsupported between the stock material inlet and the stock material outlet as the stock material passes through the blast chamber.

3. The device as claimed in claim 1, wherein the stock material is in close proximity to the edge of the blast wheel as the stock material passes through each chamber.

4. The device as claimed in claim 1, wherein the blast wheel projects abrasive in a direction substantially perpendicular to the stock material as the stock material passes through each chamber such that the blast wheel forms elliptical blast zone and the stock material traverses a linear path in the blast zone that coincides with the plane of the elliptical blast zone.

5. The device as claimed in claim 1, wherein the stock material is metal wire, metal rod, or metal tubing.

6. The device as claimed in claim 1, wherein spent abrasive is collected in each blast chamber and recycled to the blast wheels after passing through a rotating drum separator to remove dirt and debris.

7. A device for cleaning stock material, wherein the device comprises:

(A) an enclosed first blast chamber for receiving abrasive projected by two blast wheels, wherein the first blast chamber has a stock material inlet for passage of stock material into the first blast chamber and a stock material outlet for discharge of treated stock material out of the first blast chamber;

(B) an enclosed second blast chamber for receiving abrasive projected by two blast wheels, wherein the second blast chamber has a stock material inlet for receiving stock material from the stock material outlet of the first chamber, and a stock material outlet for discharge of treated stock material out of the second blast chamber;

wherein each blast wheel has throwing surfaces for projecting abrasive in an abrasive pattern having a blast zone in the blast chamber such that each blast zone is in the path of the stock material passing through each blast chamber, and wherein the throwing surfaces on the blast wheels do not face each other when abrasive is being projected by each wheel; and wherein ¼ of the surface area of the stock material is treated by each blast wheel such that the whole surface area of the stock material is treated after the stock material passes through the first blast chamber and through the second blast chamber.

8. The device as claimed in claim 7, wherein the stock material is unsupported between the stock material inlet and the stock material outlet as the stock material passes through the blast chamber.

9. The device as claimed in claim 7, wherein the stock material is in close proximity to the edge of the blast wheel as the stock material passes through each chamber.

10. The device as claimed in claim 7, wherein the blast wheel projects abrasive in a direction substantially perpendicular to the stock material as the stock material passes through each chamber such that the blast wheel forms elliptical blast zone and the stock material traverses a linear path in the blast zone that coincides with the plane of the elliptical blast zone.

11. The device as claimed in claim 7, wherein the stock material is metal wire, metal rod, or metal tubing.

12. The device as claimed in claim 7, wherein spent abrasive is collected in each blast chamber and recycled to the blast wheels after passing through a rotating drum separator to remove dirt and debris.

* * * * *